US007497314B2

(12) United States Patent
Umeda

(10) Patent No.: US 7,497,314 B2
(45) Date of Patent: Mar. 3, 2009

(54) DENOMINATION DISTINGUISHING SYSTEM IN COIN PROCESSING APPARATUS

(75) Inventor: Masayoshi Umeda, Iwatsuki (JP)

(73) Assignee: Asahi Seiko Kabushiki Kaisha, Tokyo (JP)

( * ) Notice: Subject to any disclaimer, the term of this patent is extended or adjusted under 35 U.S.C. 154(b) by 529 days.

(21) Appl. No.: 11/272,849

(22) Filed: Nov. 14, 2005

(65) Prior Publication Data

US 2006/0113161 A1 Jun. 1, 2006

(30) Foreign Application Priority Data

Nov. 16, 2004 (JP) ..... 2004-332364

(51) Int. Cl.
*G07D 1/00* (2006.01)

(52) U.S. Cl. ..... 194/302

(58) Field of Classification Search ..... 194/302
See application file for complete search history.

(56) References Cited

U.S. PATENT DOCUMENTS

| | | | | |
|---|---|---|---|---|
| 3,079,934 A | | 3/1963 | Thompson | |
| 4,167,949 A | | 9/1979 | Hashimoto | |
| 4,635,661 A | | 1/1987 | Uematsu et al. | |
| 5,163,868 A | * | 11/1992 | Adams et al. | 453/11 |
| 5,724,785 A | | 3/1998 | Malanowski | |
| 5,904,236 A | * | 5/1999 | Affeldt et al. | 198/464.4 |
| 5,908,351 A | | 6/1999 | Tanaka | |
| 5,989,118 A | | 11/1999 | Chiba et al. | |
| 6,039,643 A | * | 3/2000 | Kurosawa et al. | 453/3 |
| 6,109,416 A | | 8/2000 | Nickerson | |

FOREIGN PATENT DOCUMENTS

| | | |
|---|---|---|
| JP | 404294480 A | 10/1992 |
| JP | 405159128 A | 6/1993 |
| JP | 6-274740 | 9/1994 |
| JP | 08171666 | 7/1996 |
| JP | 9-319912 | 12/1997 |
| JP | 11-328470 | 11/1999 |

* cited by examiner

*Primary Examiner*—Patrick Mackey
*Assistant Examiner*—Mark Beauchaine

(57) ABSTRACT

Coins of different denominations can be deposited and sorted by a let off device. Sensors can determine the various denominations of the coins as the coins are translated by an endless conveying unit. Coin sorting units are positioned along the path of the coin transportation and can be activated by a control unit wherein coins can be diverted by a solenoid unit and also released through openings in guide-rails sized to the particular denomination of the coins. A detector unit can determine the passage of push units mounted on the endless conveyer unit to time the activation of the solenoids.

11 Claims, 9 Drawing Sheets

DENOMINATION DISTINGUISHING SYSTEM IN COIN PROCESSING APPARATUS

BACKGROUND OF THE INVENTION

1. Field of the Invention

The present invention relates to a denomination distinguishing system in a coin processing apparatus, in which coins of a plurality of denomination types, received in a bulk state, are sorted by each denomination type. Further, the present invention relates to a denomination distinguishing system in a coin processing apparatus, in which the timing for an operation of a receiving unit for receiving coins of a plurality of denomination types can be accurately controlled. Also, the present invention relates to a denomination distinguishing system for coins, wherein a receiving unit is operated in conjunction with a transport apparatus for transporting the coins.

2. Description of Related Art

The term "coin" used in the present specification includes currency coin, token, and medal, and may be in a circular shape or in a polygonal shape. In the past, a denomination distinguishing system for coin processing apparatus has been known, in which coins are moved along a predetermined route by pins mounted at appropriate pitch on a chain, and in the process to transport the coins along the transport route, counting of pulses is started when the coin passes through identifying means for identifying the denomination type. By operating a disengaging unit when the count value reaches a predetermined value, the coins are sorted to denomination types as appropriate and are held e.g., see Laid-Open Patent Application JP-A-11-328470 (FIG. 1; page 4)

According to the prior art as described above, the disengaging unit is operated according to a count value of pulses issued from a pulse generator. As a result, pulses may be erroneously counted due to noise or other causes. Because of the erroneous counting, the disengaging unit cannot be operated at the appropriate timing, and there has been a problem in that the coins of the appropriate denomination type cannot be classified at the appropriate position. To overcome this problem, it has been proposed to provide the denomination distinguishing unit immediately before the disengaging unit, and when the denomination type has been identified, the disengaging means is operated immediately after and the coins are sorted. However, this means that a sensor is required for each denomination type, leading to high cost, and thus cannot be adopted in a practical application.

SUMMARY OF THE INVENTION

It is an object of the present invention to provide a coin sorting system in a coin processing apparatus, which is not influenced by noise and other causes. It is another object of the present invention to provide a coin sorting system in a coin processing apparatus at low cost.

To attain the above objects, the coin sorting system for a coin processing apparatus according to the present invention is provided as a denomination distinguishing system for a coin processing apparatus, wherein coins of a plurality of denomination types are sorted one by one in a let-off device, coins are transferred to pushing unit mounted on an endless unit with a predetermined spacing, the coins are then transported through the transport route by said pushing unit, the coins are sorted at the coin sorting units according to the denomination types by a denomination distinguishing unit. The coin processing apparatus further comprises a detector unit for detecting said pushing unit arranged at a predetermined position in the advancing route of said pushing unit, coin receiving units are arranged at coin sorting units as appropriate. A control unit for operating said receiving unit according to a denomination type signal from said denomination distinguishing unit and a detection signal from said detecting unit.

According to the arrangement as described above, the coins are sorted one by one by the coin let-off device. Then, the coins are stopped by the pushing unit of the advancing unit and are transported along the transport route as appropriate. During the above process, a denomination type of each coin is identified by the denomination distinguishing unit. Also, the pushing unit for transporting coins is detected by the detector unit each time the coin passes through. The distance from the denomination distinguishing unit to the sorting unit of the denomination type is determined in a single operation. By counting a detecting signal from the detector unit, it is possible to set the timing for operation of the receiving unit for the denomination type. Because the receiving unit is operated according to the detection of the pushing unit of the advancing unit, erroneous counting does not occur. Also, the detector unit is common to all types of pushing units, and only one type of detector unit is required. This contributes to a cost reduction.

A denomination distinguishing system for a coin processing apparatus, wherein coins of a plurality of denomination types are sorted one by one in a let-off device, coins are transferred to pushing units vaunted on an endless unit with a predetermined spacing, the coins are then transported through a transport route by said pushing units. The coins are sorted according to each denomination type at a coin sorting unit for each denomination type. The coin processing apparatus comprises a slanting section when said advancing unit advances from said let-off device obliquely upward, a first horizontal section following after said slanting section and arranged approximately in a horizontal direction, a vertical section following after said first horizontal section and arranged approximately in a vertical direction, a second horizontal section following after said vertical section and positioned above said first horizontal section and arranged approximately in a horizontal direction.

Coin sorting units are positioned along a route from said second horizontal section to said let-off device and arranged to face said first horizontal section and said second horizontal section. Coin receiving units for catching coins are arranged at least for each one of said coin sorting units. Coins are stopped by said pushing units and transported by said advancing unit. Denomination distinguishing units are arranged to face the coin route of said slanting section and for detecting features of the coins.

A detector unit detects the pushing unit arranged to face the advancing route of said pushing unit of said second horizontal section and for detecting said pushing units, and a control unit for controlling the receiving operation of said receiving units according to a feature signal from said denomination distinguishing units and a detection signal from said detector unit for detecting said pushing units. In this system, coins are sorted one by one by the coin let-off device. Then, the coins are stopped and caught by the pushing units of the advancing unit, and the coins are transported along the transport route as appropriate. The transport route comprises a slanting section, a first horizontal section, a vertical section, a second horizontal section, and a circulating route leading from said second horizontal section to the let-off device.

During this process, the features of each coin are detected by the denomination distinguishing units arranged at the slanting section, and denomination type of each coin is identified by the denomination distinguishing units. The pushing unit contacts the coins and transports the coins in the appropriate direction as the advancing unit advances in the appropriate direction. The detector unit detects the pushing units each time the pushing unit passes through, and a detection signal is issued. The pushing unit is mounted on the advancing unit at appropriate spacing. Thus, the distance from the detector unit can be determined according to the number of pushing units. In other words, the distance from the denomination distinguishing unit to the sorting unit of each denomination type is easily determined. Thus, by counting the detection signal from the detector unit, it is possible to set the timing for operation of the receiving unit for each denomination type. Therefore, the control unit controls the operation of the receiving unit according to a feature signal from the denomination distinguishing unit and a detection signal from the detector unit. Thus, no erroneous counting occurs. Also, the detector unit is commonly used for all types of pushing units. As a result, only one detector unit is required, and this contributes to the reduction of the cost.

The advancing unit can be a chain comprising link plates connected by linking units, and said pushing units are integrally mounted on said linking units.

In the arrangement as described above, the advancing unit is a chain- The strength of the chain is very high against the advancing resistance when the pushing units pushes the coins, and the chain is not extended. Therefore, it is advantageous in that the timing for operation of the receiving unit is not deviated.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

Figure 1:
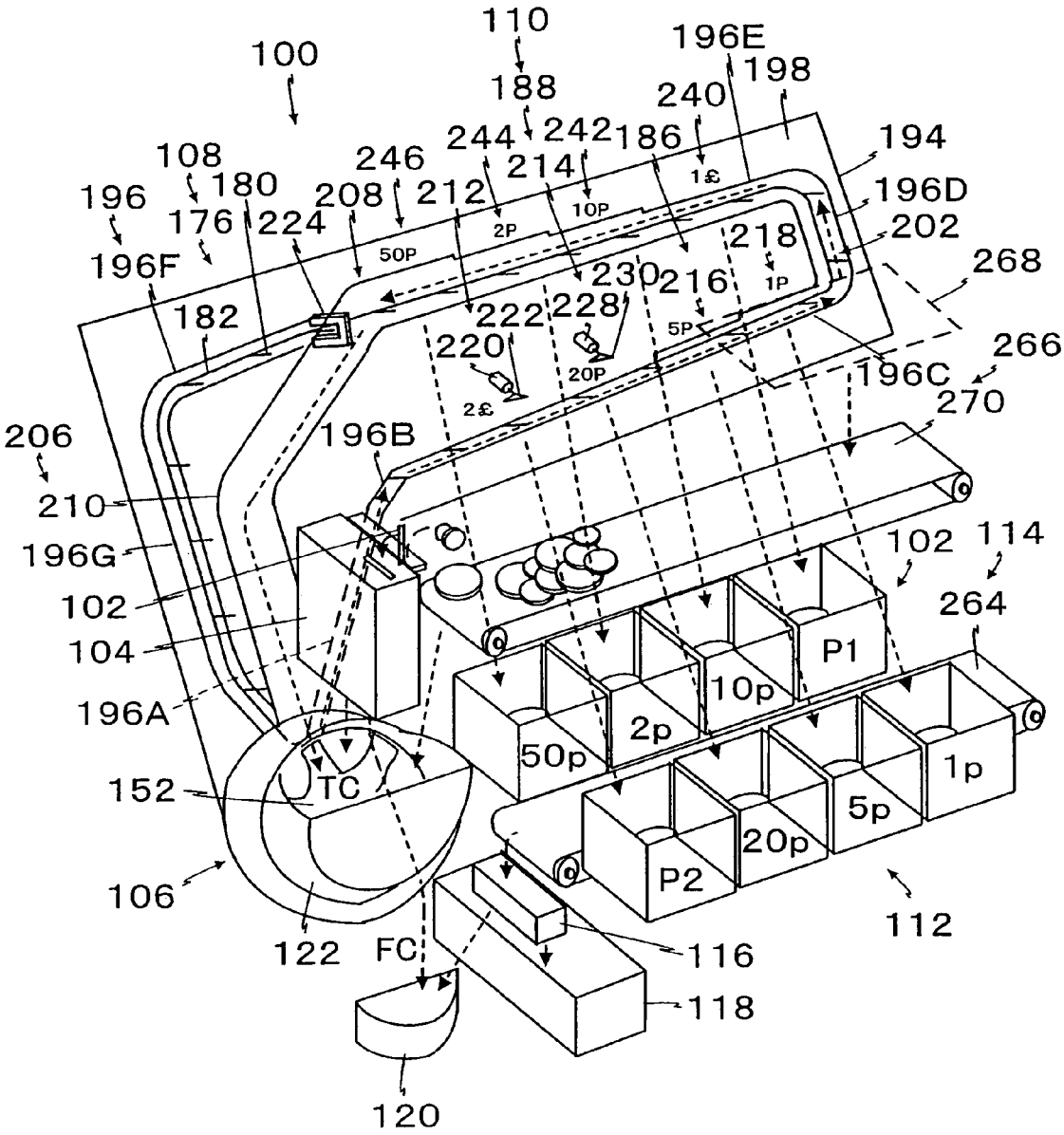
FIG. 1 is a schematical perspective view of a denomination distinguishing system for a coin processing apparatus according to an embodiment of the present invention.

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The present embodiment shows a coin processing apparatus for sorting coins of 8 different denomination types in the United Kingdom, i.e., 2 pound coin (average diameter 28.5 mm (the same applies hereinafter)), 1 pound coin (22.5 mm), 50 pence coin (27.3 mm), 20 pence coin (21.4 mm), 10 pence coin (24.5 mm), 5 pence coin (17.9 mm), 2 pence coin (26 mm), and 1 penny coin (20.3 mm). However, the present invention can be applied to coins used in other countries.

FIG. 1 shows a coin processing apparatus 100 used in supermarkets where customers want to settle the account by self-service. The coin processing apparatus 100 comprises a coin slot 102, a coin selector 104, a coin letoff device 106, a coin transporting unit 108, a coin sorting unit (apparatus) 110, a coin storing unit 112, a dispensed coin transporting unit 114, a dispensed coin diverting unit 116, a safe for overflowing coins 118, and a coin discharging unit 120.

First, a description will be given on the coin slot 102. The coin slot 102 has the function to receive the coins dropped or thrown in by customers. The coin slot 102 shown in the embodiment is designed as a slit in a form of a longitudinally oblong rectangle to receive the coins one by one.

However, the coin slot 102 may be designed in such manner that it is changed to a receiving container in form of a bowl to receive the coins in bulk state, and after the coins are sorted and separated one by one by a sorting unit already known, the coins are thrown into a coin selector 104.

Next, the coin selector 104, shown in FIG. 1, will be described. The coin selector 104 is positioned under the coin slot 102, and it has the function to identify authenticity and denomination type of the coins received through the coin slot 102 and to sort genuine or authentic coins to discriminate them from false or counterfeit coins. In the coin selector 104 shown in the embodiment, counterfeit coins are sent back to the coin dispensing unit 120 in form of a bowl via a chute (not shown).

The genuine coin TC is guided via a chute (not shown) into the storing bowl 122 of the coin let-off device 106. Therefore, the coin selector 104 can be divided into three different types: an electric type coin selector to detect material, diameter and thickness of the coin by means of a plurality of oscillation coils and to compare the result with the reference value, an image type coin selector to incorporate a pattern on coin surface by means such as CCD camera and to compare it with the reference value, and a sound wave type coin selector to hit the coin and to detect sound wave issued from the coin and to compare the result with the reference value.

Next, the coin let-off device 106 will be described. The coin let-off device 106 has the function to sort a plurality of coins of different denomination types mixed together and to deliver them one by one. Therefore, the coin let-off device 106 may be replaced with other type of apparatus, which has a similar function.

Figure 2:
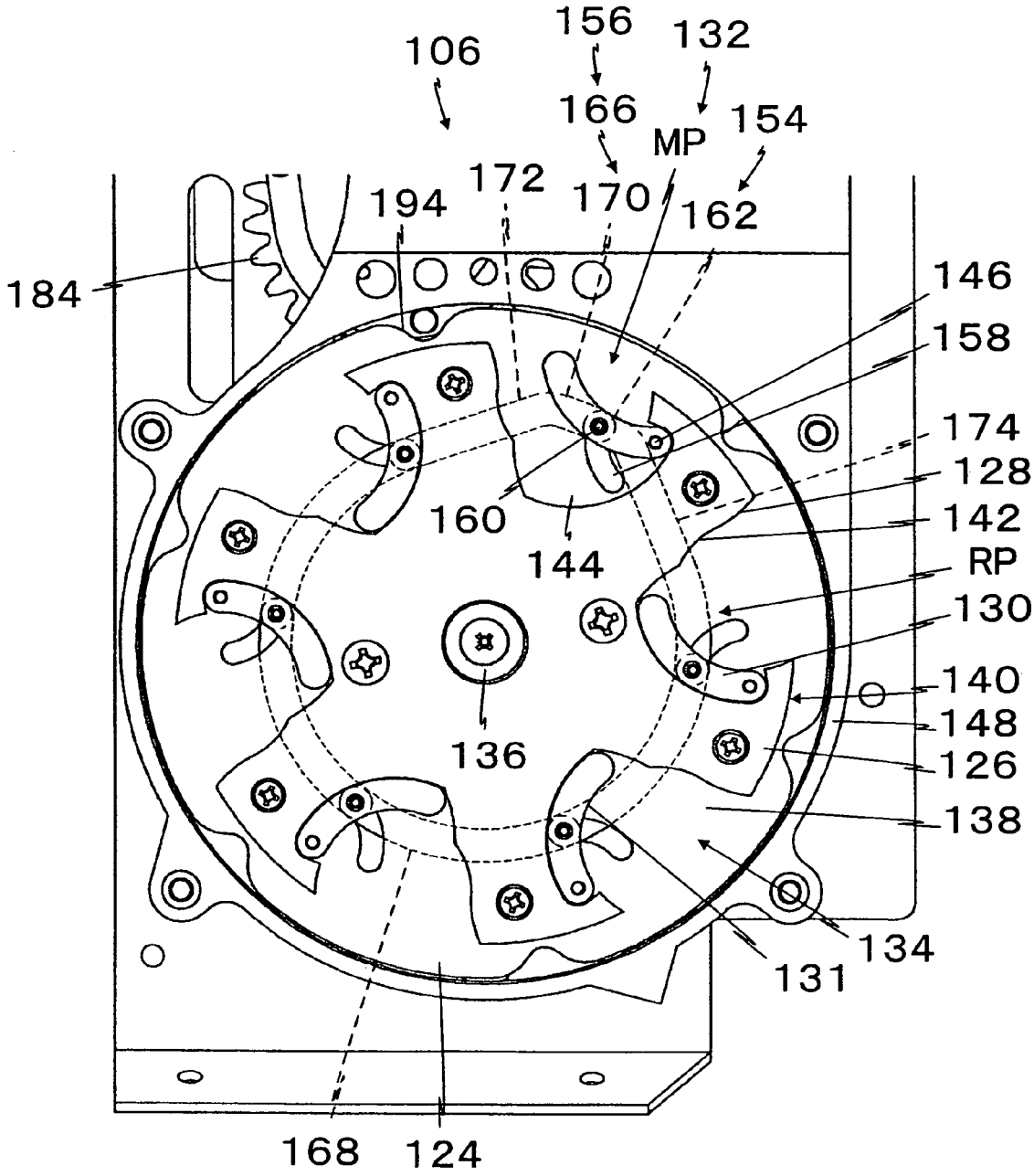
FIG. 2 is a schematical front view of a coin let-off device according to the embodiment of the present invention.

The coin let-off device 106 shown in the embodiment comprises a rotating disc 124, a recess 128 formed between projections 126, a moving unit 130 for moving coins, and a driving unit 132 for a moving unit 130 as shown in FIG. 2.

First, description will be given on the rotating disc 124. The rotating disc 124 has the function to move and shake up a multiple of coins and to sort them by introducing the coins one by one into a sorting recess 134 as described later. The rotating disc 124 is designed in the form of a disc. Its rotation shaft 136 is tilted at an angle of about 30 degrees to the vertical line, and it comprises an upward facing surface 138.

On the upward facing surface 138, there are provided 6 projections 126 each extending in radial direction, and a push-out disc 140 with recesses 128 positioned between the projections 126 is fixed on it. In front of the projection 126 and in rotating direction of the rotating disc 124, a coin pushing unit 142 slightly recessed is formed.

Behind the projection 126, in the rotating direction, a moving unit receiver 144, designed in recessed form, is provided, and the moving unit 130 in arcuate form is disposed on it. The rotating disc 124 and the push-out disc 140 may be integrally molded by using sintered metal or resin having wear resistant property.

Next, the moving unit 130 will be described. The moving unit 130 has the function to move the coin C held in the sorting recess 134 at a predetermined position in the direction of the diameter of the rotating disc 124. Therefore, the moving unit 130 may have other structure if the same function can be fulfilled.

The moving unit 130 is pivotally mounted on a pivot axis 146, which is protruded to the moving unit receiver 144 on a peripheral edge side of the rotating disc 124. The moving unit 130 is preferably made of metal or resin by giving full consideration on wear resistant property and mechanical strength.

A fan-shaped sorting recess 134 is formed by a recess 128 and an inner edge 131 of the moving unit 130. The recess 134 is designed as a flat gap with its upper face and peripheral side in an open condition. The depth of the recess 134, i.e. thickness of the push-out disc 140, is formed with a thickness, which is slightly thinner than the thickness of one penny coin, i.e. the thinnest coin among 8 types of coins.

This is to prevent the coins from being held with two coins overlapped on each other. The recess 134 is designed in fan-shaped form. Also, a distance between inner surface of the storing ring 148 and the deepest portion of the recess 134 is set to a value less than twofold of the diameter 17.9 mm of a 5 pence coin, which has the smallest diameter. This is to prevent the coins from being held with two 5 pence coins aligned together in the recess 134.

This is because the length of the recess 134 in peripheral direction and radial direction is less than twofold of the diameter of a 5 pence coin. Then the moving unit 130 is positioned on the receiving unit 144, the moving unit 130 is positioned at the receiving position PP. The rotating disc 124 is disposed at the bottom of the storing ring 148 in cylindrical shape to hold coins.

On a transfer unit to the coin transporting unit 108 of the storing ring 148, an opening 150 is formed so that coins can pass through it. A storing bowl 122 is further mounted on the storing ring 148, and a storing section 152 is provided to face toward the rotating disc 124. Thus, the coins thrown into the storing section 152 are guided toward the rotating disc 124.

Next, description will be given on a driving unit 132 for the moving unit 130. The driving unit 132 has the function to move the moving unit 130 from the receiving position RP to the moving position MP as appropriate. Therefore, the driving unit 132 may have a structure other than that of the embodiment if it can fulfill this function. The driving unit 132 comprises a driven unit 154 and a cam 156.

First, the driven unit 154 will be described. On the rotating disc 124, an arcuate through-hole 158 is formed around a pivot axis 146, and a pin 160 fixed at the middle of the moving unit 130 is penetrating through the hole. At a lower end of the pin 160, a roller 162 is rotatably mounted. This roller 162 is the driven unit 154.

Next, the cam 156 will be described. The driven unit 154 is movably inserted into a ditch-like cam 166 on an upper surface of an inward facing flange 164, which is formed in ring-like shape from an inner peripheral surface of the storing ring 148 toward the center.

In the ditch cam 166, there are provided a receiving groove 168 having a partial circular shape formed around the rotation axis of the rotating disc 124, a moving groove 170 having a diameter larger than that of the receiving groove 168 and for holding the moving unit 130 at the moving position MP, a transfer process groove 172 for a process to move from the receiving groove 168 to the moving groove 170, and a return process groove 174, in which the coins are sent back from the moving groove 170 to the receiving groove 168.

Therefore, in case the driven unit 154 is positioned in the receiving groove 168, the moving unit 130 is held by the receiving unit 144, and it is at the receiving position P2. The recess 128 and the moving unit 130 make up together a fan-shaped sorting recess 134. The sorting recess 134 is disposed at such a position that the bottom closest to the rotation axis 136 (the forward end of the moving unit 130 in the embodiment) is separated by a distance slightly different from a diameter of the coin with the largest diameter from an inner surface of the storing ring 148.

Also, this distance is less than twofold of the diameter of the coin with the smallest diameter. In other words, the sorting recess 136 is designed in such manner that two coins with the smallest diameter cannot be aligned in line and cannot be received together in the direction of the diameter of the rotating disc 124 between the storing ring 148 and the bottom.

Further, the sorting recess 234 is designed in a fan-like shape, and this prevents two coins with the smaller diameter from being aligned in line and received in peripheral direction of the rotating disc 130. In case the driven unit 154 is positioned at the transfer process groove 172, the moving unit 130 is pivotally moved clockwise around the pivot axis 146.

When the driven unit 154 is positioned in the moving groove 170, the moving unit 120 moves to the moving position MP. Then, the driven unit 154 is positioned in the return process groove 174. Thus, it is rotated counterclockwise around the pivot axis 146 and is sent back to the receiving position RP.

Therefore, the cam 156 is not limited to the ditch cam 166. In case the ditch cam 166 is used, an auxiliary unit to move the driven unit 154 along the cam 156 is not needed. This is helpful to attain a simplified structure and contributes to more compact design and to the reduction of the manufacturing cost.

Next, description will be given on the coin transporting unit 108 of FIG. 1. The coin transporting unit 108 has the function to receive the coins C, which are sent out one by one from the coin let-off device and to transport them to the coin processing apparatus, e.g. the coin sorting units 110.

The coin transporting unit 108 comprises an endless conveying unit 176, pushing units 180 such as pins or posts mounted on the endless conveying unit 176, and a guide plate 194 for guiding the coins C while the coins are leaning on it. The endless unit 176 is a loop unit, which can be bent such as a belt or chain, in the present embodiment, it is a chain 182 with a predetermined length.

Figure 7:
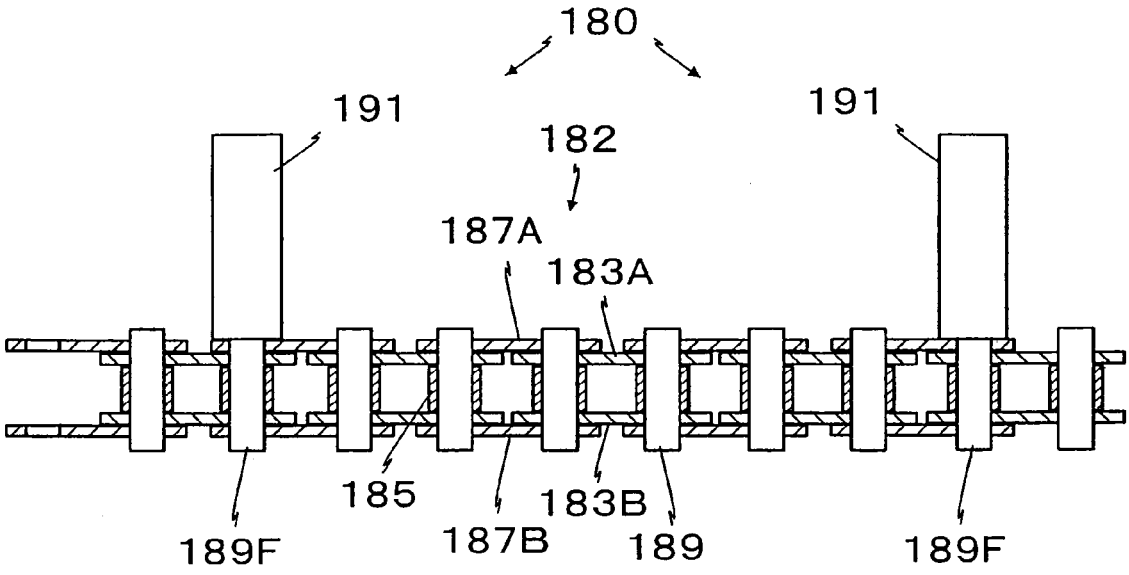
FIG. 7 is a cross-sectional view of an endless unit in the embodiment of the present invention.

As shown in FIG. 7, the chain 182 comprises a pair of cocoon-like inner link plates 183A and 183B. These link plates are separated at a given spacing with a bushing 185 sandwiched therebetween at each and of the link plates so that the link plates run in parallel to each other. On outer side of each of these inner link plates, a pair of cocoon-like outer link plates 187A and 187B are attached. Further, pins 189 are penetrating through the bushing 185, through the inner link plates 183A and 183B, and through the outer link plates 187A and 187B. By securing both ends of each of the pins 189, the inner link plates 183A and 183E and the outer link plates 187A and 187B can be bent using the pins as fulcrum.

Among the pins 189, a pin 189F positioned at a given spacing has a bar 191 to contact coins, which is projected with one end protruding in a lateral direction from the outer link plate 187A. In other words, the bar 191 is protruding in a direction perpendicular to longitudinal direction of the chain 182. Therefore, the linking units are the pins 189 and 189F.

In the present embodiment, the bar 191 is designed in cylindrical shape, and it comprises a pushing unit 180 for pushing the coins. The endless unit 176 can be replaced with a belt. When the endless unit 176 is designed as a flat belt, projections protruding at a given spacing may be provided in the direction perpendicular to longitudinal direction of the flat belt, and these projections may be used as the pushing unit 180.

When the endless conveying unit 176 is designed as a round belt, the pushing units 180 can be arranged at predetermined spacings by binding the round belt by a binder mounted at the base of the pushing unit 180. The chain 182 is guided by a plurality of sprockets (not shown), and it circulates along an inverted L-shaped loop route as a whole.

Figure 3:
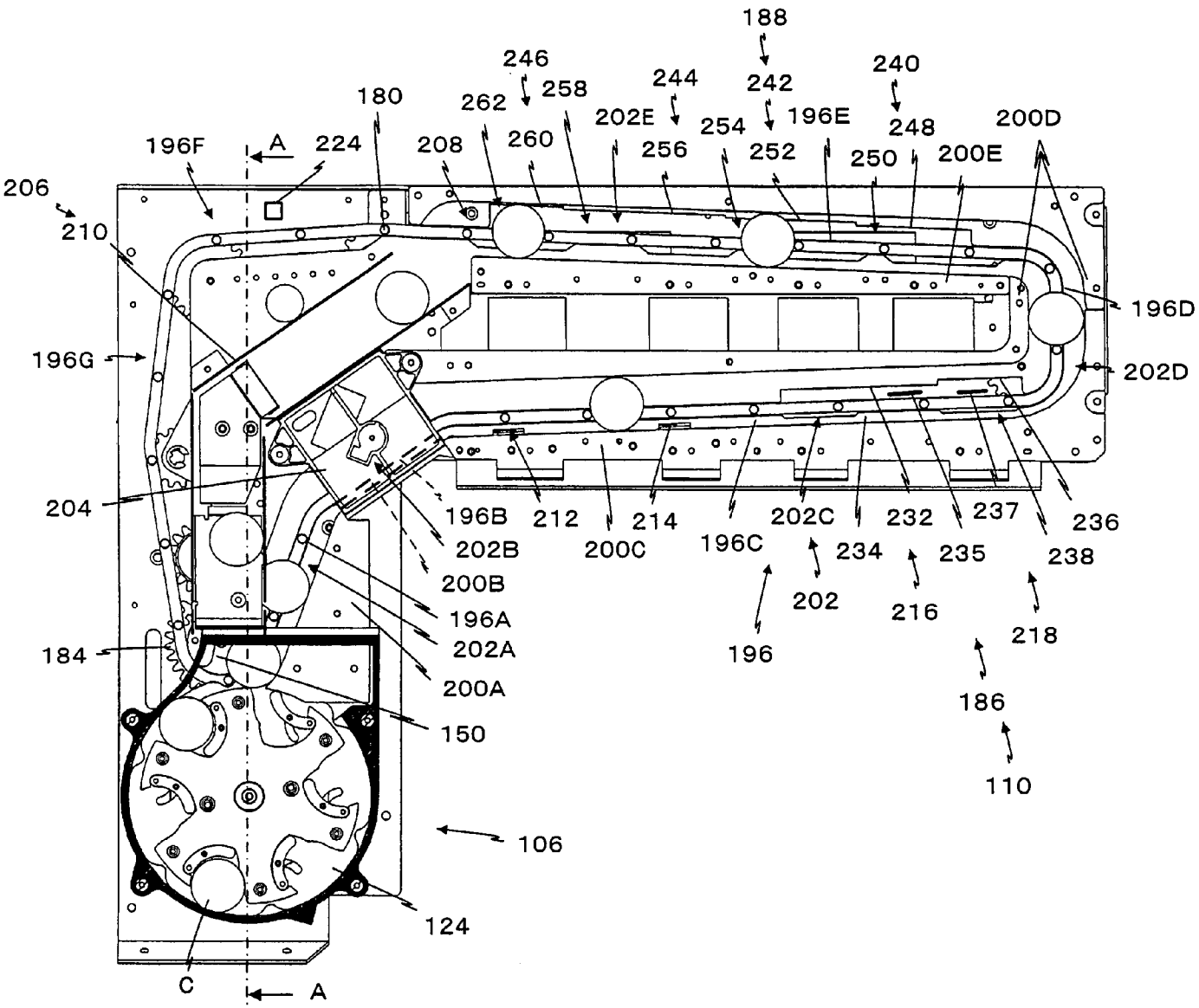
FIG. 3 is a schematical front view of a denomination distinguishing system for the coin processing apparatus according to the embodiment of the present invention.

Now, the route of the chain 182 will be explained. As shown in FIG. 3, the chain reaches a position closest to the top of the rotating disc 124 at the sprocket 184, which is adjacent to the rotating disc 124 at the lowest position. Then, the chain goes upward at a steep angle. Subsequently, the chain advances to a first sorting unit 186 along a gently rising slope. Then, after going up in a vertical direction, the chain advances to a second sorting unit 188 along a gently rising slope at a position above the first sorting unit 186. Finally, the chain goes down approximately in vertical direction and returns to the sprocket 184.

The pushing unit 180 is positioned on the side of the chain 182 at a predetermined spacing so that it can contact and catch the coins C one by one, which are sent out from the coin let-off device 106. As a result, the sprocket 184 and the rotating disc 124 are rotated as these two are interlocked with each other.

Figure 4:
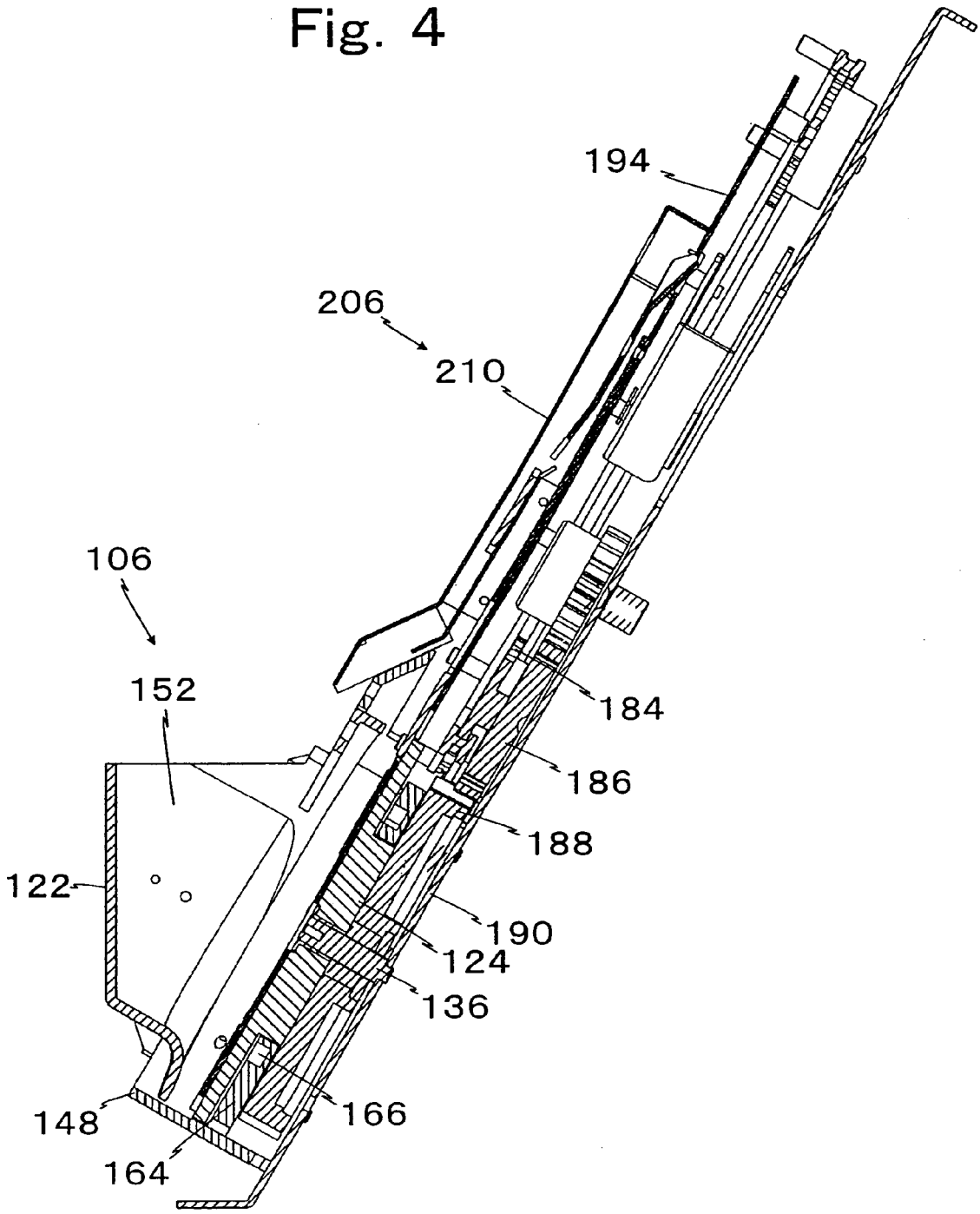
FIG. 4 is a cross-sectional view along the line A-A in FIG. 3.

As shown in FIG. 4, a gear 186, where the sprocket 184 is fixed, is engaged with another gear 188, which is arranged under the rotating disc 124. In other words, the gear 188 is rotatably mounted on a shaft 136 fixed on a base 190, and the rotating disc 124 is fixed on the gear 188. The gear 188 is engaged with the gear 186 at a lateral position, and the gear 188 is driven by an electric motor (not shown) at a predetermined speed.

Therefore, the rotating disc 124 and the sprocket 184 are rotated and moved at a predetermined speed ratio. In other words, the sorting recess 134 and the pushing means 180 are moved relative to each other. On an outer peripheral edge of the projection 126 of the rotating disc 124, notches 194 are formed so that coins can be smoothly delivered from the moving unit 130 to the pushing means 180 and the pushing means 180 can enter each of the notches 194.

The guide plate 194 is an L-shaped plate, which is tilted in the same manner as the rotating disc 124 of the coin let-off device 106. The moving groove, where the pushing units 180 are fixed on the chain 182 is moved, is designed in loop-like shape on the guide plate 194.

In other words, the endless unit 176 is arranged on back side of the guide plate 194. Now, a description will be given on the shape of the moving groove 196 with the starting point at the sprocket 184, which is arranged adjacent to the coin let-off device 106.

The moving groove 196 comprises a first moving groove 196A rising obliquely at a steep angle, a second moving groove 196B rising at an angle of about 45°, a third moving groove 196C rising at a gentle inclination, a fourth moving groove 196D extending vertically upward, a fifth moving groove 196 positioned above the third moving groove 196C and rising at slightly upward inclination toward the first moving groove 196A. A sixth moving groove 196F extending approximately in horizontal direction, and a seventh moving groove 196G extending downward vertically toward the sprocket 184. As a whole, the moving groove is in a sideways turned L-shaped configuration.

A coin guide in planar shape is arranged on the upward facing surface 198 of the guide plate 194, and it guides the peripheral surface of the coin C, which is moved by the endless unit 176. Specifically, there are provided a first coin guide 200A facing to the lower side of the first moving groove 196A, a second coin guide 200E facing to the lower side of the second moving groove 1968, a third coin guide 200C facing to the lower side of the third moving groove 196C, a fourth coin guide 200D facing to left and right sides of the fourth moving groove 196D, and a fifth coin guide 200E facing to the lower side of the fifth moving groove 196E.

The thickness of each of the first coin guide 200A, the second coin guide 200B, and the fourth coin guide 200D is designed to be slightly thicker than the thickness of the thickest coin. More specifically, the thickness of each of these coin guides is designed to be slightly thicker than the thickness of a 2 pound coin, which is the thickest coin among the coins. This prevents the coins from dropping off from the coin guide when the coins C are pushed by the pushing unit 180.

The thickness of each of the third coin guide 200C and the fifth coin guide 200E is designed to be slightly thicker than the thickness of the thinnest coin. More concretely, it is designed to be slightly thicker than the thickness of the thinnest coin. This is to promote easier dropping of the coins C under movement from the coin guides 200C and 200E. Therefore, the coins C which are delivered after being sorted one by one from the let-off device 106, are contacted and caught by the pushing unit 180 and are moved along a transport route 202.

Describing in more detail, the coins C are transported in the order of: a first transport route 202A where the coins C are guided by the first coin guide 200A and moved, a second transport route 202B, i.e. a slanting section, where the coins are guided by the second coin guide 200B and moved, a third transport route 202C, i.e. a first horizontal section, where the coins are guided by the third coin guide 200C and moved, a fourth transport route 202D, i.e. a vertical section, where the coins are guided by the fourth coin guide 200A and moved, and a fifth transport route 202E, i.e. a second horizontal section, where the coins are guided by the fifth coin guide 200E and moved.

A denomination distinguishing unit 204 is arranged on the second transport route 202B as shown in FIG. 3. The denomination distinguishing unit 204 has the function to identify a 2 pound coin and a 20 pence coin from each other in the present embodiment. For instance, it can identify and discriminate the coins by identifying the diameter and material of the coins from the data sensed by a plurality of oscillation coils.

Next, a description will be given on a guiding unit 206. The guiding unit 206 has the function to guide the coins to the coin let-off device when the coins C reach the end of the fifth transport route 202E, i.e. the most downstream portion 208 of the transport route 202. In the embodiment, a tube type chute 210 is provided, which guides the coins from the most downstream portion 208 of the fifth transport route 202E positioned above the coin let-off device 106 to the storing bowl 122 of the coin letoff device 106.

Specifically, the coin C slips off through the chute 120 by its own weight and is dropped into the storing section 152 of the coin let-off device 106. Therefore, the coins C, which have not been sorted by the coin sorting unit 110, are sent back to the coin letoff device 106 via the chute 210, and it is transferred again from the let-off device 106 to the coin transporting unit 108. As a result, the coins are sorted at the denomination type sorting unit or the coins are continuously circulated.

Next, description will be given on the coin sorting unit 110. The coin sorting unit 110 has the function to sort the coins for each denomination type as the coins are transported along the transport route 202 by the coin transporting unit 108. A first sorting unit 186 is provided along the third transport route 202C. Specifically, in the first sorting unit 186, there are provided a coin receiving unit 211, a 5 pence coin sorting unit 216, and a one penny coin sorting unit 218 in this order from upstream side in advancing direction of the endless unit 176 toward the downstream side.

The coin receiving unit 211 comprises a 2 pound coin sorting unit 212 and a 20 pence coin sorting unit 214. The 2 pound coin sorting unit 212 comprises a diverting plate 222, which is protruded by an actuator (e.g. solenoid) 220 at a given timing to the transport route between the third coin guide 200C and the moving route of the pushing unit 180.

Figure 8:
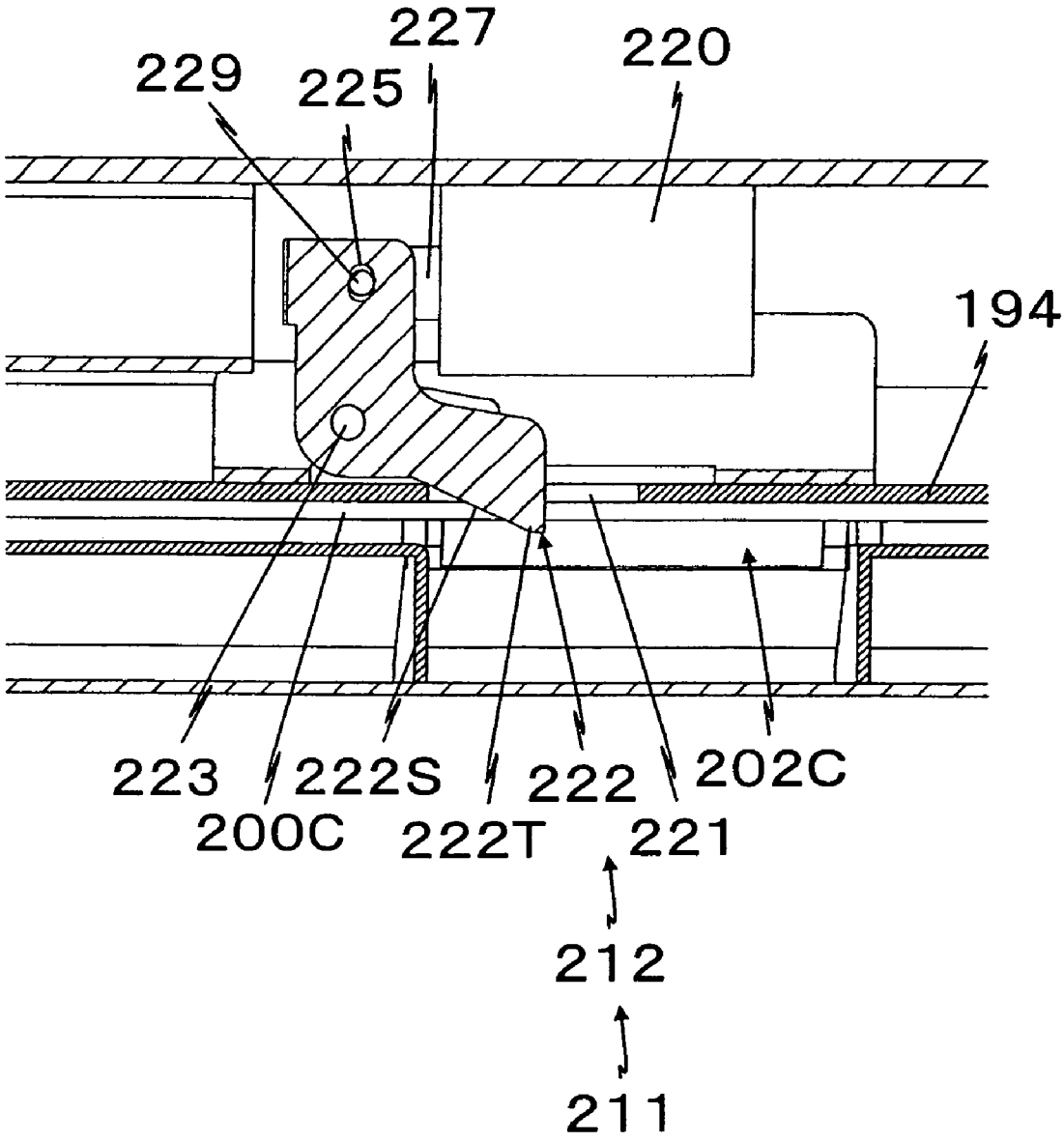
FIG. 8 is a horizontal sectional view of a receiving unit in the embodiment of the present invention.

More concretely, a slit 211 extending along the endless unit 176 is formed on the transport route 202C on the guide plate 194 as shown in FIG. 8. On the backside of the guide plate 194, an L-shaped diverting plate 222 is rotatably mounted at the bending portion so that it can be rotated around an axis 223. A pin 229 fixed on a tip of a plunger 227 of the solenoid 220 is inserted into an oblong hole 225 formed on one end of the diverting plate 222.

The plunger 227 is driven by a spring (not shown) so that it is compelled to protrude from the solenoid 220. Therefore, the diverting plate 222 is pivotally moved counterclockwise in FIG. 8, and its forward end is retracted from the slit 221 and is positioned behind the guide plate 194.

Figure 10:
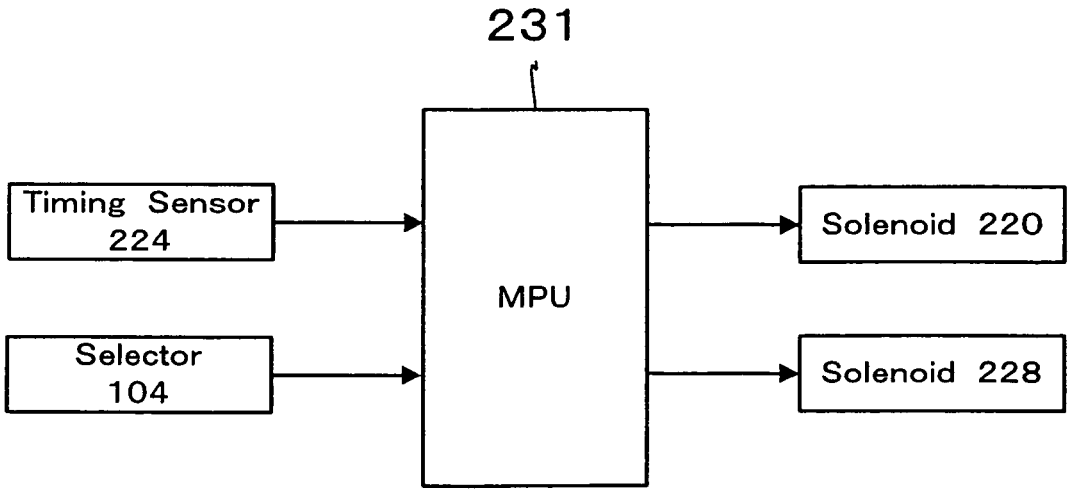
FIG. 10 is a block diagram of a control circuit of the embodiment of the present invention.

Next, description will be given on a control unit 231 as shown in FIG. 10. The control unit 231 can be a microprocessor or micro-controller, for instance. It receives a denomination type signal from the coin selector 104 and a timing signal from a sensor or detector unit 224 for detecting the passage of a pushing unit 180, and issues a pulse signal. Then, based on a program stored in a ROM in advance, the solenoid 220 or the solenoid 228 is magnetized and demagnetized, see FIGS. 1 and 8.

When the solenoid 220 is magnetized, the plunger 227 is retracted. The diverting plate 222 is pivotally moved clockwise, and its tip 222T is protruded into the transport route 202C through the slit 221. In this case, an inclined surface 222S of the diverting plate 222, which forms the tip 222T, is tilted so that it is separated from the guide plate 194 with respect to the advancing direction of the coin.

After a 2 pound coin is detected by the denomination distinguishing means 204 and when a predetermined number of pulse signals, e.g., a pulse signal, is issued from the detecting unit 224, which detects the pushing unit 180, the solenoid 220 is magnetized for a certain period of time. When the solenoid 220 is magnetized, the diverting plate 222 is protruded into the third transport route 202C. As a result, the 2 pound coin moving along the transport route 202C is moved with its tip separated from the guide plate 194 due to the inclined surface 222S of the diverting plate 222. Thus, the coin is disengaged from the third coin guide 200C and is dropped off downward.

The dropped 2 pound coin is guided through a chute (not shown) and is sent into the storing bowl of a coin hopper P2 for the 2 pound coin as described later. The 20 pence coin sorting unit 214 comprises a solenoid 228 and a diverting plate 230 designed in the same manner as in the 2 pound coin sorting unit 212.

After the coin has been identified as a 20 pence coin by the denomination distinguishing unit 204 and when two pulse signals are issued from the detector unit 224 for detecting the pushing unit 180, the solenoid 228 is magnetized for a given period of time. When the solenoid 228 is magnetized, the diverting plate 230 is protruded into the third transport route 202C. As a result, the 20 pence coin moving along the transport route 202C is moved so that its tip is separated from the guide plate 194 due to the inclined surface of the diverting plate 230. Thus, the coin is diverted from the third coin guide 200C and is dropped off downward.

The dropped 20 pence coin is guided through a chute (not shown) and is sent into a 20 pence storing bowl of the coin hopper for 20 pence coins as described later. The 2 pound coins are sorted at first because 2 pound coins are bimetal coins and the easiest to sort.

The 20 pence coins are sorted as the second coin type to be sorted. This is because the difference of diameters between 20 pence coin and 1 pound coin is small. If tolerance of diameter of coin is taken into account and when sorting is performed mechanically according to the difference of diameters, the coins may be erroneously sorted. Also, it is because 20 pence coins are more easily sorted electrically than 1 pound coins. However, it is possible to change over the position between the 2 pound coin sorting unit 212 and the 20 pence coin sorting unit 214.

Figure 9:
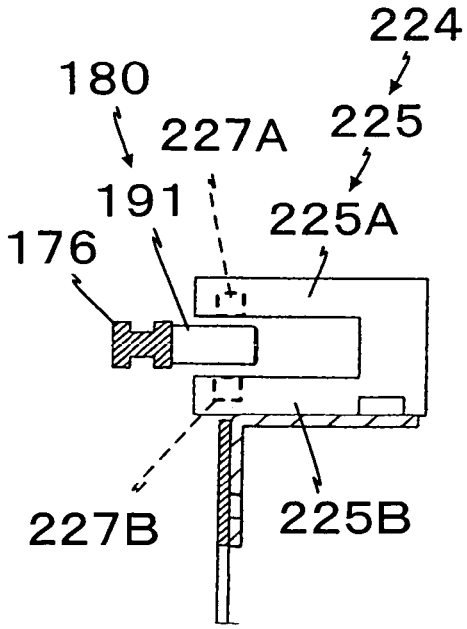
FIG. 9 is a longitudinal sectional view of means for detecting the pushing means in the embodiment of the present invention.

The detector unit 224 for detecting pushing unit 180 is a sensor for detecting the pushing unit 180 mounted on the endless unit 176, and it has the function to issue a pulse signal each time the passing of the pushing unit is detected. More concretely, it can comprise a channel-shaped sensor body 225, which includes an upper bar 225A and a lower bar 225B arranged above and below respectively and separated by a given distance from each other as shown in FIG. 9.

A photo acceptance unit 227A is provided on the upper bar 225A. A light emission element 227E is arranged on the lower bar 225B. These elements together make up a transmission type photoelectric sensor. A projected light from the light emission element 2278 is arranged to traverse the moving route of the pushing unit 180. Thus, when the projected light from the light emission element 227E is interrupted by the pushing unit 180, the pushing means 180 is detected.

Therefore, the detector unit 224 for detecting the pushing unit can be replaced with another type of device, which has a similar function. When the pushing unit 180 is made of metal, a proximity sensor or a contact type sensor can be used as the detector unit 224 for detecting pushing unit. When it is made of resin, a photoelectric sensor can be used.

Next, a description will be given on a 5 pence coin sorting unit 216. The 5 pence coin sorting unit 216 comprises a 5 pence coin sorting opening 234 defined by a 5 pence coin edge 232, which is arranged at a given distance from and in parallel to the third coin guide 200C, i.e., at a position separated by a distance slightly longer than the diameter of the 5 pence coin.

The 5 pence coin has the smallest diameter among the coins except 2 pound coin and 20 pence coin. Because it cannot be supported by the 5 pence coin edge 232, upper end of the 5 pence coin falls off into the 5 pence coin sorting opening 234. Thus, lower peripheral surface of the coin is disengaged from the third coin guide 200C and the coin drops off. Then, being guided through a chute (not shown), the coin is sent into a coin hopper 5*p* for 5 pence coin as described later.

Figure 6:
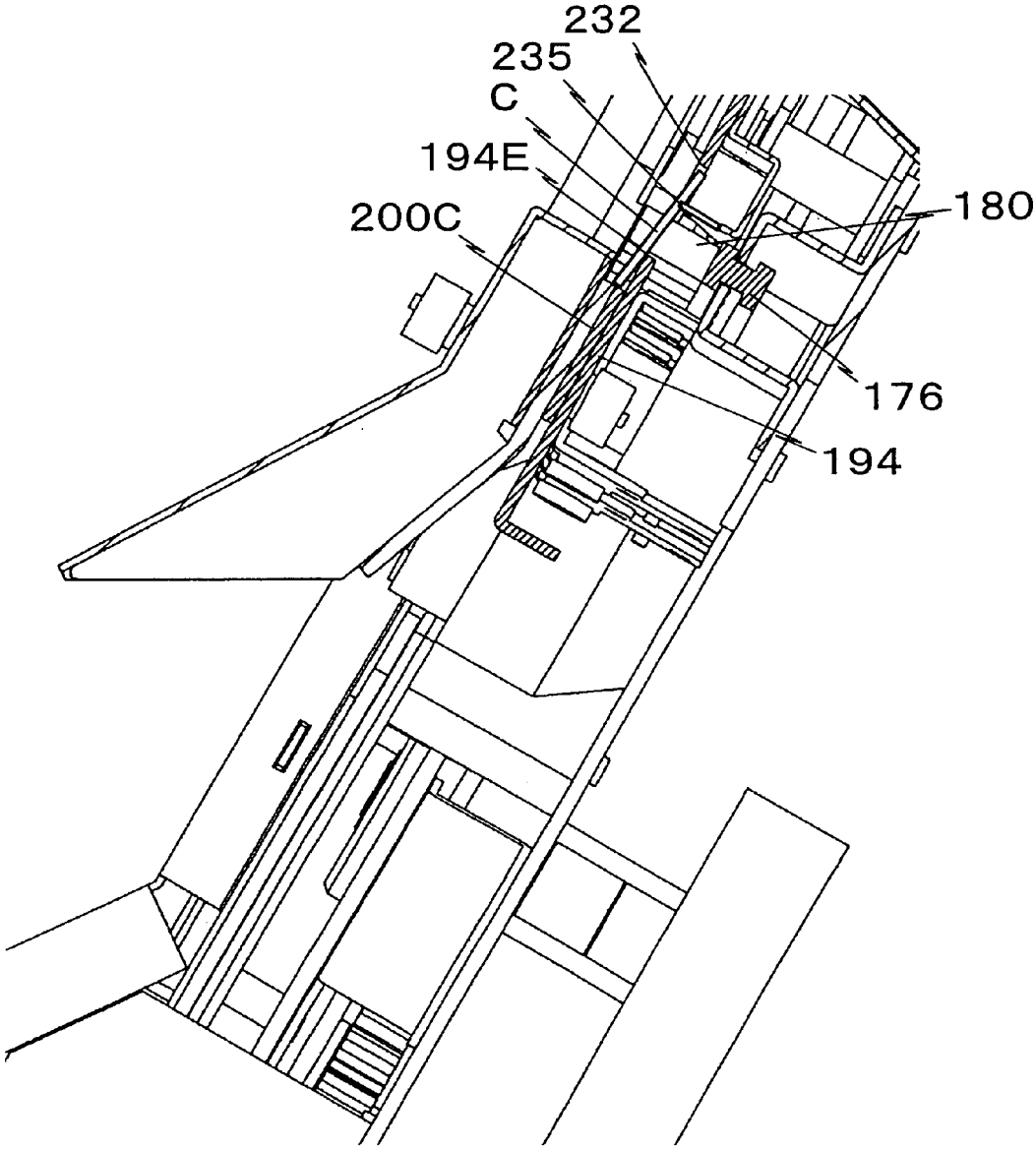
FIG. 6 is a longitudinal sectional view of a fall supporting unit in the embodiment of the present invention.

In this case, the 5 pence coin may not be dropped off easily from the second coin guide 200C because the coin is light in weight. Specifically, when the 5 pence coin C is not guided by the 5 pence coin edge 232 as shown in FIG. 6, the lower surface of the coin is rotated clockwise with an edge 194E of the guide plate 194 as a fulcrum.

In order to prevent the coin C from dropping off into the 5 pence coin opening 234 but to allow it to drop off from the third coin guide 200C, it should be designed in such manner that the lower peripheral surface of the coin C is disengaged from the third coin guide 200C when the coin falls off slightly into the opening 234. In other words, the rotation fulcrum of the coin Q i.e. the edge 194E, must be separated by a given distance from the coin guide 200C.

Figure 5:
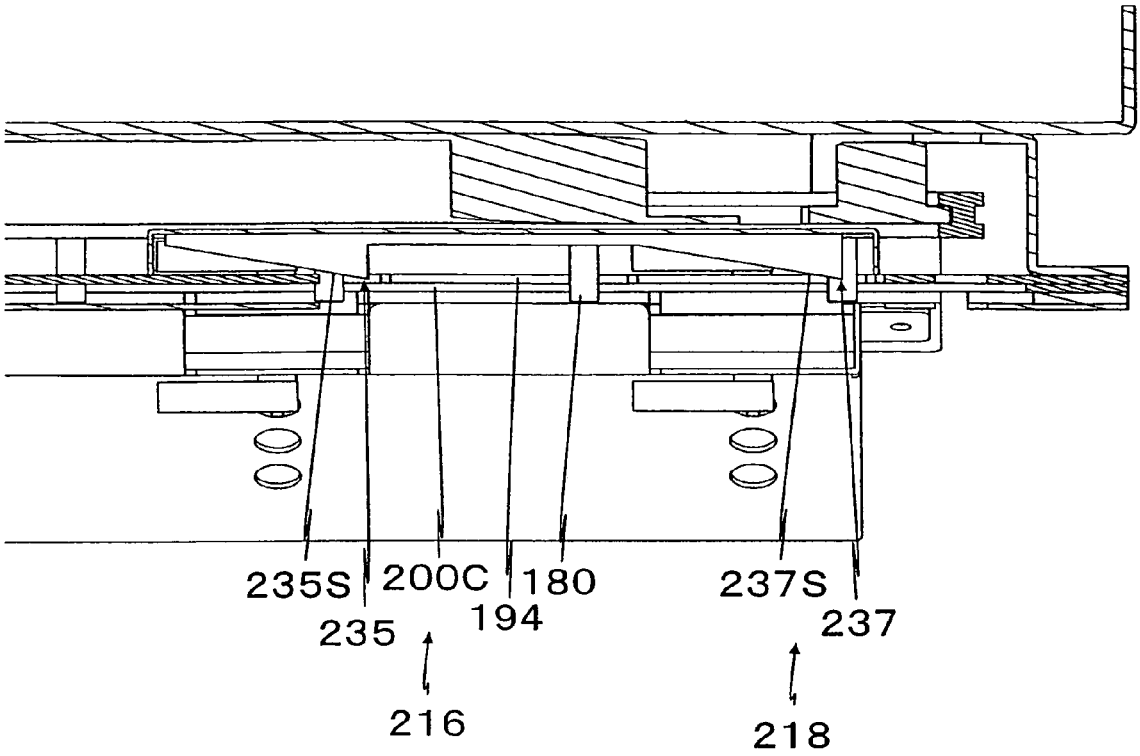
FIG. 5 is a horizontal sectional view of a fall supporting unit in the embodiment of the present invention.

When this distance is long, the moment caused by self-weight of the coin is low, and the coin is very unlikely to fall off. As a result, the 5 pence coin may not be correctly sorted at the 5 pence coin sorting unit 216. To prevent this, a fall supporting unit 235 is provided between the moving route of the pushing unit 180 and the 5 pence coin edge 232. As shown in FIG. 5, the fall supporting unit 235 is designed in a triangular shape. Its inclined surface 235S is extended in an advancing direction of the endless unit 176, and it is arranged in such manner that it comes closer to rear surface of the third transport route 202C as it moves downstream.

With the arrangement as described above, even when the distance from the third guide rail 200C to the edge 194E is made shorter and the moment due to self-weight of the coin is increased, lower surface of the upper end of the coin C is supported by the inclined surface 235S of the fall supporting unit 235 as the coin is rotated by a certain degree, and the coin is prevented from dropping off from the opening 202C. Further, the 5 pence coin supported by the inclined surface 235S is pushed by the pushing unit 180. As a result, the front part, in advancing direction, is rotated on the third coin guide 200C so that it is separated from the guide plate 194. Then, a lower surface of the central part of the 5 pence coin is disengaged from the third coin guide 200C, and the coin is dropped off from the third coin guide 200C.

Now, a description will be given on 1 penny coin sorting unit 218. The 1 penny coin sorting unit 218 has a 1 penny coin sorting opening 238 defined by a 1 penny coin edge 236, which is arranged at a position separated by a given distance from and in parallel to the third coin guide 200C, i.e. at a position separated by a distance slightly longer than diameter of the 1 penny coin. A fall supporting unit 237 having a configuration similar to that of the fall supporting unit 235 is provided, and it is arranged at the same positional relationship as the fall supporting unit 235.

The 1 penny coin has the second smallest diameter among the coins except 2 pound coin and 20 pence coin, and it cannot be supported by the 1 penny coin edge 236. Thus, the upper end of the coin falls down into the 1 penny coin sorting opening 238. As it is supported by the fall supporting unit 237, it comes off from the third coin guide 200C and drops off. Being guided through a chute (not shown), the coin is sent into a coin hopper 1p for 1 penny coin as described later.

Next, a description will be given on a second sorting unit 188. From an upstream side in the transporting direction of the coin transporting unit 108, there are provided a 1 pound coin sorting unit 240, a 10 pence coin sorting unit 242, a 2 pence coin sorting unit 244, and a 50 pence coin sorting unit 246 in this order.

Although not shown in the figure, the fall supporting unit is arranged in the same manner as described above at the opening of each of the sorting units. However, these coins have relatively larger diameters and are heavier in weight, and the fall supporting unit may not be provided.

First, description will be given on the 1 pound coin sorting unit 240. The 1 pound coin sorting unit 240 comprises a 1 pound coin sorting opening 250 defined by a 1 pound coin edge 248, which is positioned at a given distance from and in parallel to the fifth coin guide 200E, i.e. at a position separated by a distance slightly longer than the diameter of the 1 pound coin.

The 1 pound coin has the third smallest diameter among the coins except the 2 pound coin and the 20 pence coin, and it is not supported by the 1 pound coin edge 248. The upper end of the coin falls off into the 1 pound coin sorting opening 250. Then, the coin is disengaged from the fifth coin guide 200E. Being guided through a chute (not shown), the coin is sent into a coin hopper P1 for 1 pound coin as described later.

Next, a description will be given on a 10 pence coin sorting unit 242. The 10 pence coin sorting unit 242 has a 10 pence coin sorting opening 254 defined by a 10 pence coin edge 252 positioned at a given distance from and in parallel to the fifth coin guide 200E, i.e., at a position separated by a distance slightly longer than the diameter of the 10 pence coin.

The 10 pence coin has the fourth smallest diameter among the coins except the 2 pound coin and the 20 pence coin, and it is not supported by the 10 pence coin edge 252. The upper end of the coin falls off into the 10 pence coin sorting opening 254, and it is disengaged from the fifth coin guide 200E. Being guided through a chute (not shown), the coin is sent into a coin hopper 10*p* for 10 pence coin.

Next, a description will be given on a 2 pence coin sorting unit 244. The 2 pence coin sorting unit 244 has a 2 pence coin sorting opening 258 defined by a 2 pence coin edge 256 positioned at a given distance from and in parallel to the fifth coin guide 200E, i.e. at a position separated by a distance slightly longer than the diameter of the 2 pence coin.

The 2 pence coin has the fifth smallest diameter among the coins except the 2 pound coin and the 20 pence coin, and it is not supported by the 2 pence coin edge 256. The upper end of the coin falls off into the 2 pence coin sorting unit 258, and the coin is disengaged from the fifth coin guide 200E. Being guided through a chute (not shown), the coin is sent into a coin hopper 2*p* for 2 pence coin.

Next, a description will be given on a 50 pence coin sorting unit 246. The 50 pence coin sorting unit 246 has a 50 pence coin sorting opening 262 defined by a 50 pence coin edge 260 positioned at a given distance from and in parallel to the fifth coin guide 200E, i.e., at a position separated by a distance slightly longer than the diameter of the 50 pence coin.

The 50 pence coin has the largest diameter among the coins except the 2 pound coin and the 20 pence coin, and it is not supported by the 50 pence coin edge 260. The upper end of the coin falls off into the 50 pence coin sorting opening 262, and it is disengaged from the fifth coin guide 200E. Being guided through a chute (not shown), the coin is sent into a coin hopper 50*p* for 50 pence coin as described later.

Next, description will be given on a coin storing section 112. The coin storing section 112 holds coins for each of the denomination type. When a discharge command is issued from a commanding apparatus (not shown), it has the function to discharge a designated number of coins of the designated denomination type. Therefore, the coin storing section 112 may be replaced with another device having a similar function.

In the present embodiment, the coin storing section 112 comprises coin hoppers P2 to 50*p* provided for coins of different denomination types. Each of the coin hoppers P2 to 50*p* has the function to sort the coins stored in bulk state in the storing bowl one by one and to discharge the coins to the dispensed coin transporting unit 114.

The coin hoppers P2, 20*p*, 5*p* and 1*p* are aligned in line to match the first sorting unit 186 and are arranged above one side of the coin transporting unit 114. The coin hoppers 50*p*, 2P, 10*p* and 1*p* are aligned in line to match the second sorting unit 188 and are arranged above the other side of the coin transporting unit 114.

Next, a description will be given on a dispensed coin transporting unit 114. The dispensed coin transporting unit 114 has a function to transport the coins discharged from the coin hoppers P2 to 50*p* in a predetermined direction.

In the present embodiment, the dispensed coin transporting unit 114 is designed as a flat belt 264 arranged approximately in a horizontal direction between the rows of the coin hoppers. It is moved in a given direction by an electric motor (not shown) and transports the coins C discharged from each of the hoppers toward the coin dispensing unit 116.

Next, a description will be given on the coin dispensing unit 116. The coin dispensing unit 116 has the function to dispense the coins C received from the dispensed coin transporting unit 114 to a safe for overflowing coins 118 or to a coin dispensing unit 120.

Only when the overflowing coins are discharged from one of the coin hoppers P2 to 50*p*, does the coin dispensing unit 116 guides the received coins C to the safe for the overflowing coins 118. Otherwise, it guides the coins to the coin dispensing unit 120.

Next, a description will be given on the safe for the overflowing coins 118. The safe for the overflowing coins 118 has the function to hold the coins received from the dispensed coin diverting unit 116. A change money supplying unit 266 is arranged above the coin storing section 112.

The change money supplying unit 266 has the function to supply the coins in bulk state thrown in through the opening 268 to the storing bowl 122 of the coin let-off device 106. In the present embodiment, it comprises a flat belt 270 arranged approximately in horizontal direction. When the cover of the housing is opened and a predetermined number of various types of coins are thrown in through the opening 268, the coins are placed in bulk state on the flat belt 270.

When the coins in bulk state are detected by a sensor (not shown), the flat belt 270 is moved at slow speed toward the coin let-off device 106. When the coins C reach the end of the flat belt 270, the coins C fall off. The coins are then guided through a chute (not shown) toward the storing section 152 of the coin let-off device 106.

When a predetermined number of the coins C are detected at the storing section 152 by a sensor arranged on the coin let-off device 106, the advancing movement of the flat belt 270 is stopped, and the supply of the coins C for change purpose is stopped.

When the sensor detects that the storing section 152 is empty, the flat belt 270 is moved again, and the coins C are supplied to the storing section 152. This procedure is repeated. When there is no more coin C on the flat belt 270 or in the storing section 152, the denomination distinguishing unit 204 does not detect the coins for a given period of time. Then, the termination of the supply of change money is notified by a non-detection signal.

Next, description will be given on operation of the present embodiment. After the coins C are thrown into the coin slot 102, it is judged whether the coin is authentic or not at the coin selector 104. Genuine or authentic coin C drops into the storing bowl 152 of the coin let-off device 106.

When a sensor (not shown) detects the coin C in the storing bowl 152, an electric motor (not shown) is driven, and the sprocket 184 is rotated. As a result, the chain 182 is moved counterclockwise at a predetermined speed as shown in FIG. 1 and FIG. 3.

Also, the rotating disc 124 is rotated clockwise and in synchronization with the chain 182 via the gears 186 and 188. Then, the coins, which have been inserted, slip off toward the rotating disc 124 because the bottom of the storing bowl 122 is inclined, and the coins come into contact with the rotating disc 124 and the push-out disc 140.

As the rotating disc 124 is rotated, the coins C are shaken up by the projections 126 and are moved into the sorting recess 134. The moving unit 130 is positioned in the receiving unit 144 except the position near the coin transporting unit 108, and it is at the receiving position RP. In other words, the recess 134 is designed in a fan-shaped configuration.

Therefore, only one of the coins C is held in the sorting recess 134, which is defined by a pushing portion 142 of the projection 126 and by an arcuate inner edge 131 of the moving unit 130. Specifically, an outer periphery of the coin C is guided by the storing ring 148. Thus, only one coin, i.e. the coin C with the largest diameter, is held in the recess 134, which is formed slightly deeper than the diameter of the coin with the largest diameter (2 pound coin).

Because its depth is less than twofold of the diameter of the coin with the smallest diameter (5 pence coin), two pieces of the coins with the smallest diameter cannot move together in the direction of the diameter of the rotary disk 124. Further, the recess 134 is designed in the fan-shaped configuration, and two pieces of the 5 pence coins with smallest diameter cannot be aligned together towards the peripheral direction of the rotating disc 124.

Therefore, only one piece of the supplied coins can be held in the sorting recess 134, including the 5 pence coin with the smallest diameter. The coins C held in the recess 134 are moved toward the coin transporting unit 108 as the rotating disc 124 is rotated. In other words, the coins C are moved upward from downward position.

In this case, the coins C are moved as they are pushed by the pushing portion 142, and almost no force is applied on the moving unit 130. When the moving unit 130 is moved to a position closer to the coin transporting unit 108, the driven unit 154 is moved into the transfer process groove 172. Thus, the driven unit 154 is moved in the direction of the diameter of the rotating disc 124.

As a result, the moving unit 130 is pivotally moved clockwise with the pivot axis 146 as a fulcrum. Therefore, the moving unit 130 pushes the coins C positioned at the sorting recess 134 toward the direction of the diameter of the rotating disc 124, and the coins C are pushed out of the sorting recess 134.

When the driven unit 154 is positioned in the moving groove 170, the moving unit 130 is moved to the moving position MP. The coins C pass through the opening 150 and are pushed toward the moving route of the pushing means 180.

Immediately after the coins C are pushed out, the coins C are contacted by the pushing unit 180 and are pushed from behind. Then, the coins C are moved by the first coin guide 200A, the second coin guide 200B, the third coin guide 200C, the fourth coin guide 200D, and the fifth coin guide 200E. In other words, the coins C are transported along the first transport route 202A, the second transport route 202C, the third transport route 202C, the fourth transport route 202D, and the fifth transport route 202E in this order.

At the second transport route 202B, the coin C is detected by the denomination distinguishing unit 204, and the denomination type is identified. When the coin C is identified as a 2 pound coin, the control unit 231 magnetizes the solenoid 220 according to the first pulse signal from the detector unit 224 for detecting the pushing unit 180 after the identifying procedure.

As the result of the magnetization, the diverting plate 222 is protruded into the transport route 202C. The 2 pound coin has its peripheral surface pushed by the pushing means 180 and guided by the second coin guide 232, and the 2 pound coin is moved to separate from the guide plate 194 because the surface 222S of the diverting plate 222 is inclined.

As a result, the 2 pound coin is disengaged from the third coin guide 200C and drops off. Being guided through a chute (not shown), the coin is sent into the coin hopper P2 and is stored in it. When the coin C is identified as a 20 pence coin, the solenoid 228 is magnetized for a given period of time according to the output of two pulse signals from the detector unit 224 for detecting the pushing unit after identifying the coin.

As the result of the magnetization, the diverting plate 230 is protruded into the transport route 202C. Thus, the 20 pence coin is moved as it is separated from the guide plate 194 by the diverting plate 230. Then, the 20 pence coin is disengaged from the third coin guide 200C and drops off. Being guided through a chute (not shown), the coin is guided into the coin hopper 20*p* and is stored in it.

In case of a coin other than a 2 pound coin and a 20 pence coin, the solenoids 220 and 228 are not magnetized according to the detection by the denomination distinguishing unit 204. The coin C thus transported passes through the 2 pound coin sorting unit 212 and the 20 pence coin sorting unit 214 and reaches the sorting unit 216 for the 5 pence coin with the smallest diameter.

When the transported coin C is a 5 pence coin, its upper end is not guided to an edge 232 of the 5 pence coin sorting opening 234. Thus, the upper end of the coin C drops into the 5 pence coin sorting opening 234. As described above, the coin is disengaged from the third coin guide 200C and drops off. Being guided through a chute (not shown), it is sent into the coin hopper 5*p* and is stored in it.

In case of a 1 penny coin, which is the second smallest coin, its diameter is longer than that of the 5 pence coin, and it passes through the 5 pence coin sorting unit 216 as it is guided along the edge 232. However, the coin is disengaged from the third coin guide 200C similarly to the case of the 5 pence coin at the 1 penny coin sorting opening 218. Being guided through a chute (not shown), the coin is sent into the coin hopper 1*p* and is stored in it.

In case of a 1 pound coin, the coin passes through the first sorting unit 186 and reaches the 1 pound coin sorting unit 240 via the fourth transport route 202D. Similarly to the case of the 5 pence coin, the coin is disengaged from the fifth coin guide 200E and drops off. Being guided through a chute (not shown), the coin is sent into the coin hopper P1 and is stored in it.

In case of a 10 pence coin, it passes through the first sorting unit 186, the fourth transport route 202D, and the 1 pound coin sorting unit 240 and reaches the 10 pence coin sorting unit 242. Similarly to the case of the 5 pence coin, the coin is disengaged from the fifth coin guide 200E and drops off. Being guided through a chute (not shown), the coin is sent into the coin hopper 10*p* and is stored in it.

In case of a 2 pence coin, it passes through a first sorting unit 186, the fourth transport route 202D, the 1 pound coin sorting unit 240, and the 10 pence coin sorting unit 242, and it reaches the 2 pence coin sorting unit 244. Similarly to the case of the 5 pence coin, the coin is disengaged from the fifth coin guide 200E and drops off. Being guided through a chute (not shown), the coin is sent into the coin hopper 2*p* and is stored in it.

In case of a 50 pence coin, the coin passes through the first sorting unit 186, the fourth transport route 202D, the 1 pound coin sorting unit 240, the 10 pence coin sorting unit 242, and the 2 pence coin sorting unit 244, and it reaches the 50 pence coin sorting unit 246. Similarly to the case of the 5 pence coin, the coin is disengaged from the fifth coin guide 200E and drops off. Being guided through a chute (not shown), the coin is sent into the coin hopper 50*p* and is stored in it.

In case a 2 pound coin is not identified by the denomination sensor unit 204, the 2 pound coin does not drop off from the 20 pence coin sorting unit 214. The coin does not drop off into the 5 pence coin sorting unit 216, the 1 penny coin sorting unit 218, the 1 pound coin sorting unit 240, the 10 pence coin sorting unit 242, the 2 pence coin sorting unit 244, and the 50 pence coin sorting unit 246, and the coin reaches the most downstream portion 208 of the transport route.

In this case, the 2 pound coin is guided by the guiding unit 206 and drops off into the storing section 152 of the coin let-off device 106. Therefore, this 2 pound coin is transferred to the coin transporting unit by the coin let-off device 106. Then, it is detected again by the sensor 204 and is sorted at the 2 pound coin sorting unit 212.

In case the coin is not sorted at the 2 pound coin sorting unit 246 for the second time, it is transferred to the coin transporting unit 108 from the coin let-off device 106 again, and it is sorted at the 2 pound coin sorting unit 246. In case the coin thrown in is a counterfeit coin, it is sorted by the coin selector 104 and is sent back to the coin dispensing unit 120.

In case the change money is given to and stored in the coin hopper 50*p* from the coin hopper P2 prior to the operation, the coins in bulk state are thrown onto the flat belt 270 through the opening 268. Then, the flat belt 270 advances as described above, and the coins C are supplied to the storing section 152 of the coin let-off device 106. As a result, the coin is transferred to the coin transporting unit 108 from the coin let-off device 106 as described above. During the transport in the first sorting unit 186 and the second sorting unit 188, the coins are sorted for each denomination type, and these are stored in the coin hoppers.

A coin receiving unit 211 may be provided in the coin sorting unit as appropriate except the specific denomination types, i.e. 2 pound coin and 20 pence coin.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. In a denomination distinguishing system for a coin processing apparatus, wherein coins of a plurality of denomination types are sorted one by one in a let-off device, coins are transferred to pushing means mounted on an endless conveying unit with a predetermined spacing, the coins are transported through a transport route by said pushing means and sorted at coin sorting units according to the denomination types by a denomination distinguishing means, the improvement comprising:

a coin receiving means arranged at the coin sorting units as appropriate among said coin sorting units;

a control means for operating said coin receiving means;

an electrical coin sorting unit arranged between said denomination distinguishing means and the coin sorting units, said electrical coin sorting unit controlled by the control means;

a detecting means for detecting the passing of said pushing means, the detecting means arranged at a predetermined position in the advancing route of said pushing means, and wherein the control means carries out control operations according to a denomination type signal from said denomination distinguishing means and a detection signal from said detecting means.

2. A denomination distinguishing system for a coin processing apparatus according to claim 1, wherein said endless conveying unit is a chain comprising link plates connected by linking units, and said pushing unit is integrally mounted on said linking units.

3. The denomination distinguishing system for a coin processing apparatus, wherein coins of a plurality of denomination types are sorted one by one in a let-off device, the coins are transferred to pushing units mounted on an endless conveying unit with a predetermined spacing, the coins are then transported through a transport route by said pushing units, the coins are sorted according to each denomination type at the coin sorting unit for each denomination type, said coin processing apparatus comprises:

a slanting section when coins advance from said let-off device obliquely upward relative to a horizontal support surface;

a first horizontal section following after said slanting section and arranged approximately in a horizontal direction;

a vertical section following after said first horizontal section and arranged approximately in a vertical direction;

a second horizontal section following after said vertical section and positioned above said first horizontal section and arranged approximately in a horizontal direction;

a plurality of coin sorting units positioned along a route from said second horizontal section to said let-off device and arranged to face said first horizontal section and said second horizontal section;

coin receiving units for catching coins arranged at each respective coin sorting unit;

denomination distinguishing unit, arranged at the coin route of said slanting section, for detecting features of the coins;

a detector unit for detecting the pushing units at said second horizontal section;

a control means for electrically operating the coin sorting units according to a denomination type signal from a denomination distinguishing unit and a detection signal from the detector unit; and a mechanical means for sorting coins according to coin diameter.

4. The denomination distinguishing system for a coin processing apparatus according to claim 3, wherein the control unit is a microprocessor.

5. In a denomination distinguishing system for a coin processing apparatus for receiving, storing and dispensing a plurality of different denominations of coins, the improvement comprising:

an endless conveying unit for translating coins horizontally in a first direction and elevating the coins to translate the coins horizontally in a second direction that is in a reverse direction to the first direction;

a coin denomination distinguishing unit for identifying the plurality of coins into respective denominations;

a plurality of coin selecting units for removing the coins from the endless conveying unit wherein a coin guide rail supports the coins and the plurality of coin selecting units include coin edge members which are located parallel to and at a predetermined distance from the coin guide rail to assist in releasing coins;

the plurality of coin selecting units further include at least one movable diverting plate that can selectively be protruded into a transport path of the coins to displace a coin from the endless conveying unit;

a plurality of coin hoppers positioned below the coin selecting units, the plurality of coin hoppers including a first set of coin hoppers and a second set of coin hoppers positioned below the coin selecting units;

a first moving groove positioned between a coin storing bowl and a second moving groove, the first moving groove rising at an upward inclination relative to a horizontal support surface in a direction toward the second moving groove;

a third moving groove positioned adjacent to the second moving groove, the second moving groove rising at an angle of about 45 degrees relative to the horizontal support surface in a direction away from the first moving groove;

a fourth moving groove positioned adjacent to the third moving groove, the third moving groove rising at an upward inclination relative to the horizontal support surface in a direction away from the first moving groove;

a fifth moving groove positioned adjacent to the fourth moving groove, the fourth moving groove extending vertically upward in a direction away from the third moving groove;

a sixth moving groove positioned adjacent to the fifth moving groove, the fifth moving groove rising at an upward inclination relative to the horizontal support surface in a direction towards the first moving groove; and a seventh moving groove positioned adjacent to the sixth moving groove, the sixth moving groove extending horizontally in a direction away from the fifth moving groove, and the seventh moving groove positioned vertically between the sixth moving groove and the first moving groove, the seventh moving groove extending vertically downward in a direction toward the first moving groove.

6. The denomination distinguishing system for a coin processing apparatus according to claim 5 wherein the endless conveying unit translates the coins along the coin guide rail and the plurality of coin selecting units are operatively positioned in both the horizontal first direction and the horizontal second direction.

7. The denomination distinguishing system for a coin processing apparatus according to claim 6 further including:

a control unit for operating the coin selecting units; and a detector unit for determining the position of coins on the endless conveying unit, wherein the control unit receives signals from the coin denomination distinguishing unit and the detector unit to activate the diverting plate.

8. The denomination distinguishing system for a coin processing apparatus according to claim 7 further including a full supporting unit along the endless conveying unit with a slanted surface to engage a coin.

9. The denomination distinguishing system for a coin processing apparatus according to claim 5 wherein the first set of coin hoppers are offset from the second set of coin hoppers.

10. The denomination distinguishing system for a coin processing apparatus according to claim 5, wherein the endless conveying unit has a first portion for transporting coins in a first direction, and a second portion for transporting coins elevated above the first portion, the second portion transporting coins in a second direction opposite the first direction.

11. The denomination distinguishing system for a coin processing apparatus according to claim 5, wherein the endless conveying unit circulates along an inverted L-shaped loop.

* * * * *